US006230414B1

(12) United States Patent
Glock

(10) Patent No.: US 6,230,414 B1
(45) Date of Patent: May 15, 2001

(54) REAR SIGHT FOR FIREARM

(76) Inventor: Gaston Glock, Hausfeldstrasse 17, A-2232, Deutsch-Wagram (AT)

( * ) Notice: Subject to any disclaimer, the term of this patent is extended or adjusted under 35 U.S.C. 154(b) by 0 days.

(21) Appl. No.: 09/105,352

(22) Filed: Jun. 26, 1998

(30) Foreign Application Priority Data

Jun. 30, 1997 (AT) ..... 1118/97

(51) Int. Cl.[7] ..... F41G 1/02
(52) U.S. Cl. ..... 33/252; 42/100
(58) Field of Search ..... 42/100; 33/252, 33/233

(56) References Cited

U.S. PATENT DOCUMENTS

| | | | | |
|---|---|---|---|---|
| 4,477,979 | * | 10/1984 | Oren | 33/257 |
| 4,628,611 | * | 12/1986 | Ruffino | 33/254 |
| 4,777,730 | * | 10/1988 | Huggins | 33/245 |
| 4,841,659 | * | 6/1989 | Williams | 42/101 |
| 4,890,407 | * | 1/1990 | Nichols | 42/100 |
| 4,940,324 | * | 7/1990 | Nichols | 356/247 |
| 5,046,277 | * | 9/1991 | Sanders | 42/101 |
| 5,063,677 | * | 11/1991 | Millett | 33/252 |
| 5,327,654 | * | 7/1994 | Parker | 33/254 |
| 5,404,667 | * | 4/1995 | Schmitter | 42/100 |
| 5,467,552 | * | 11/1995 | Cupp et al. | 42/100 |
| 5,638,604 | * | 6/1997 | Lorocco | 33/241 |
| 5,669,173 | * | 9/1997 | Rodney, Jr. | 42/101 |
| 5,836,100 | * | 11/1998 | Stover | 42/103 |
| 5,878,521 | * | 3/1999 | Warnock | 42/103 |
| 5,930,906 | * | 8/1999 | Howe et al. | 33/241 |
| 5,933,972 | * | 9/1999 | Springer, Jr. | 33/244 |

* cited by examiner

*Primary Examiner*—Michael J. Carone
*Assistant Examiner*—Denise J Buckley
(74) *Attorney, Agent, or Firm*—Kilpatrick Stockton LLP

(57) ABSTRACT

A displaceable rear sight mounted on a firearm transverse to the gun-target line and moveable in a preferably dovetailed slot transverse to the gun-target line.

The rear sight has a groove-like recess, running in a direction of the slot, proceeding from the base of the sight, which opens into an opening essentially horizontal and running parallel to the direction of the slot and parallel to the gun-target line from the front wall up to the rear wall of the sight.

8 Claims, 1 Drawing Sheet

REAR SIGHT FOR FIREARM

FIELD OF THE INVENTION

The invention relates to a rear sight which is mounted on a firearm transverse to the gun-target line and can be moved in a preferably dovetailed slot transverse to the gun-target line.

BACKGROUND OF THE INVENTION

A sight of this type, which has proven itself, is known from AT 379 447 B, which is herewith introduced into this application by reference.

Various problems have arisen when the user wanted to adjust the sight in the open; thereby the spring laid in additionally, which holds the rear sight in place, was lost due to carelessness. A further particular, not always viewed as advantageous, was that the force necessary to displace the sight changed along the path of displacement. Moreover, its manufacture was relatively expensive due to construction of plastic with a metallic insert on the underside.

Another type of sight is known from DE 34 16 696 A. It is transversely displaceable in a horizontal slot by screws disposed horizontally and transversely to the direction of travel, and vertically displaceable by a vertical adjustment screw projecting with its head into a groove of the sight whereby play related to tolerances is eliminated by springs. This construction requires several threads, screws, and springs and is accordingly expensive in construction, care, and maintenance.

BRIEF SUMMARY OF THE INVENTION

The invention aims to avoid the disadvantages of the prior-art sights and to provide a sight which is simple in construction, easy to adjust, and cost effective to manufacture.

According to the invention it is intended to provide a sight of the type stated above with a recess having an essentially T-shaped cross section by which the middle area of the lower part of the sight, which sits in the slot of the firearm, is formed to act as a spring.

The T-shaped recess therein consists, in essence, of a groove-like longitudinal indentation, running in the direction of the slot and perpendicular to the direction of travel, proceeding from the base of the sight, and of an opening, running parallel to the axis of the slot and parallel to the axis of travel and cutting through the sight from its front wall up to its rear wall. Preferably its extent, in the direction of the axis of the slot, essentially coincides with the length of the longitudinal recess in the base which, for its part, opens into the upper opening recess.

Through these two recesses, a one-piece sight is obtained which in its side regions is a solid piece from the upper part down into the lower lying guide part, but in its central section makes possible a transverse movement of the guide part with respect to the upper part through the horizontal opening whereby an elastic inward compression of the residual guide areas is made a possible by the vertical recess in the base.

These guide regions acting as springs are, according to a particular embodiment of the invention, easily formed to project outwardly, wherein these projections lie in the range of a few tenths of a millimeter, for example, 0.2 mm.

According to the invention the material from which the sight is manufactured can be metal and, in the case of steel, for example, can be manufactured by metal-cutting processing whereby it is possible, in particular for the horizontal opening, to choose manufacture by means of electrical discharge machining.

It is also possible to use metal suitable for injection molding and to make the openings and recesses with cores, which is preferable due to cost-effective manufacture.

Finally, it is of course also possible to use plastic capable of injection molding, and thereby to form the openings and recesses by cores as well.

BRIEF DESCRIPTION OF DRAWINGS

The invention is explained in more detail with the aid of the drawings.

Therein are represented.

DETAILED DESCRIPTION OF PREFERRED EMBODIMENTS

Figures 1, 2, 3, 4:
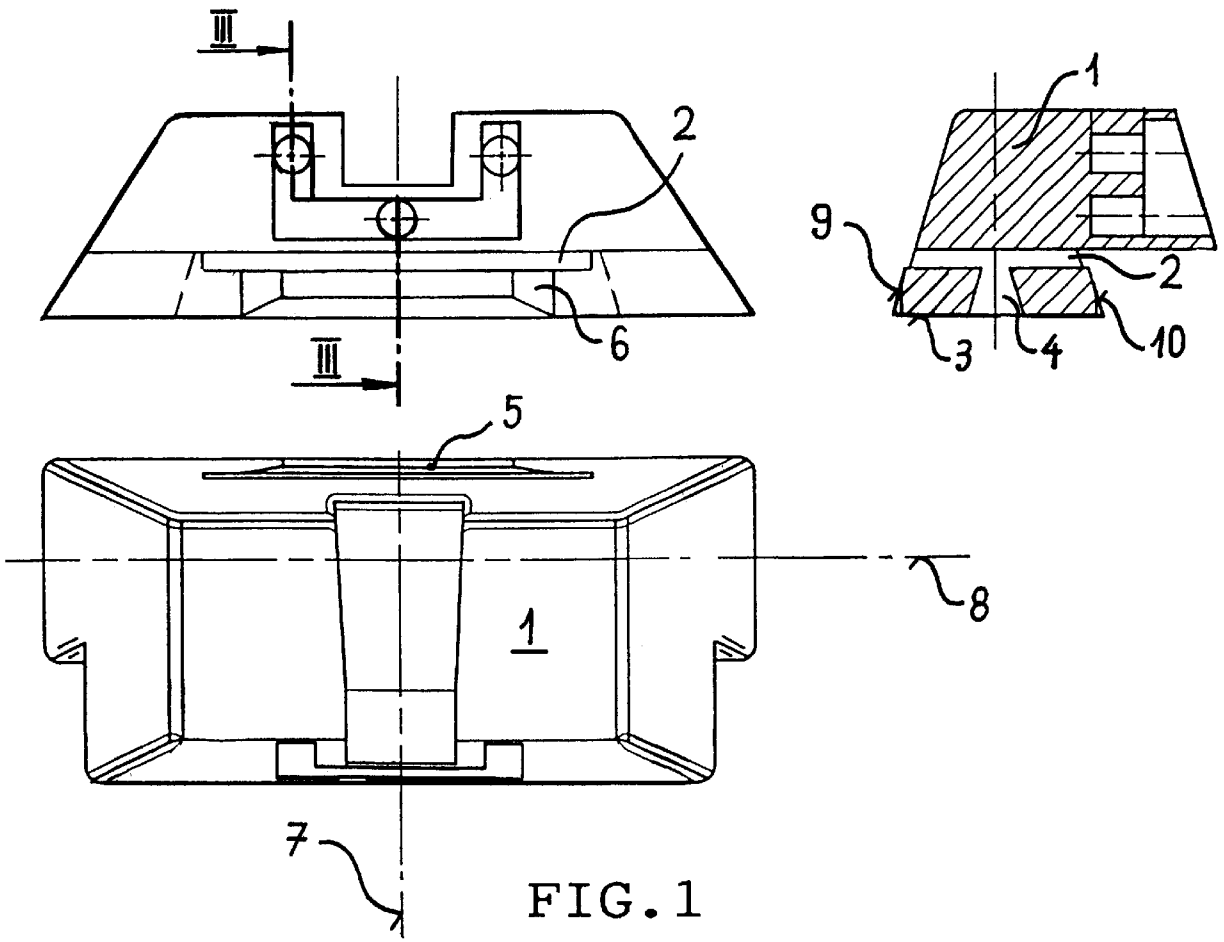
FIG. 1 a plan view of a sight according to the invention
FIG. 2 a view as seen by the intended user
FIG. 3 a section along line III—III in FIG. 2.
FIG. 4 a lateral view of the sight.

As is obvious, in particular from FIG. 3, the sight 1 according to the invention has an opening passing through and running horizontally (as the weapon is customarily held) into which a groove-like recess 4 in the base 3 of the sight 1 opens.

The situation relative to the weapon is given by the direction of the line 7 which lies parallel to the barrel, thus in the gun-target line, and the line 8 which lies parallel to the slot guidance (slot direction) for the sight.

The recess 4 is represented in FIG. 3 with oblique edges as is preferable in the case of manufacture by injection molding due to easier formability, although it is not necessary to choose such a construction. In particular, in the case of manufacture by means of milling, it is under some circumstances advantageous to form this groove-like recess 4 with parallel edges.

As can be deduced from the seamless transition of the two recesses 2 and 4 in FIG. 3, these end laterally in a plane passing through, which however is not required. Thus it can be that either the groove-like recess 4 extends further than the opening 2 passing through or also the reverse. Since the effect according to the invention only occurs in the region in which both recesses are present, the embodiment form represented or one not deviating significantly therefrom is preferred.

As follows from FIG. 3, but also from FIGS. 1 and 4, the sight 1 according to the invention has, in the elastic region of its guide section and thus in the area in which the opening 2 and the groove-like recess 4 are formed, slightly projecting elements 5, 6 on both sides. In FIG. 3 these elements are, due to the direction of sectioning, only recognizable by the overhang over the oblique faces in the head part of the sight, while their longitudinal extension can be deduced from FIGS. 1 and 2.

Due to these projecting elements 5, 6, an elastic inward springing effect of the sight in this region, essentially in the horizontal direction and thus along the opening 2, is forced by the (not represented) guide slot on the pistol. Since this inward springing effect occurs essentially in the horizontal direction, a force of displacement or restraining force that is essentially constant over the entire adjustment range is insured. This constancy of restraining force is, along with the one-piece construction, a notable advantage with respect to prior-art sights.

It is significant that, as follows in particular from FIG. 2, these projecting elements 5,6 do not extend beyond the area of spring action; preferably, they also do not reach up into the edge areas since these edge areas have, due to their connection to the actual closed, and thus relatively rigid, block of the sight, inward springing action only with the application of essentially greater force than is required in the middle area. The situation is similar to the case of bending of a cross-piece stressed on both sides, as is well known to any student of statics.

As can be deduced from the representation of the groove-like recess in FIG. 2 (broken line since not visible), the front-face formation there is somewhat different than in the section according to FIG. 3, since the opening 2 is formed with vertical front walls, but the groove-like recess is formed with oblique face walls so that the two representations according to FIG. 2 and FIG. 3 show differing forms of embodiment, even if only in minute details, which are equally good in practice.

If the opening 2 is also intended to be formed by laying of cores during manufacture by injection molding, it is thoroughly conceivable to form the two main faces not as is seen in FIG. 3, parallel to one another, but rather, in order to make forming simpler, oblique to one another. Thereby the use of a divided core is also conceivable in order to achieve a balanced visual appearance and equal inclination on both sides of the recess 2.

The invention is not restricted to the embodiment examples represented but rather can be varied and changed in different ways without compromising the extent of protection given by the claims.

What is claimed is:

1. A rear sight for displaceable mounting on a firearm having a dovetailed slot extending transverse to the gun-target line of the firearm, the sight comprising:

a guide part operable to fit in the slot of the firearm and having a lengthwise extent, the guide part having a base (3) with front and back sides along the lengthwise extent, and a front wall (9) and a rear wall (10) extending upwardly from the respective front and back sides of the base, the base and the front and rear walls adapted for a slideable fit within the slot of the firearm;

a recess (4) extending upwardly from the base, the recess running parallel to the lengthwise extent of the guide part and opening into a horizontal opening (2) formed in the guide part between the front and rear walls; and the horizontal opening having a first dimension running parallel to the lengthwise extent of the guide part and a second dimension transverse to the first dimension, and extending from the front wall to the rear wall, whereby the recess and the horizontal opening provide an elastic inward compression of the walls relative to each other when the sight is disposed in the slot of the firearm, so as to adjustably retain the sight at a selected transverse position within the slot.

2. Rear sight according to claim 1 characterized by the fact that the extent of the recess (4) and of the opening (2) in the direction of the slot (8) essentially coincide with each another.

3. Rear sight according to claim 1 characterized by the fact that the extent of the recess (4) and the opening (2) makes up between 30 and 60% of the maximum extent of the rear sight (1) in the direction of the slot (8).

4. Rear sight according to claim 8, further comprising:

projections (5, 6) on the respective front and rear walls along a region coextensive with at least part of the horizontal opening and extending outwardly from said respective walls so as to contact confronting surfaces of the slot with the sight disposed in the slot; and the elastic inward compression of the front and rear walls operates as a spring between the base (3) and the horizontal opening (2) in the region coextensive with the projections (5, 6) on the respective front and rear walls, so as to urge the projections into contact with confronting surfaces of the slot.

5. Rear sight according to claim 4 characterized by the fact that on the front wall (9) as well as on the rear wall (10), projections (5, 6) are provided and that these project by 0.05 to 0.4 mm over surrounding face areas of the walls.

6. Rear sight according to claim 3 characterized by the fact that the opening makes up between 45% and 55% of the maximum extent of the rear sight, and that the front and rear walls act as a spring between the base (3) and the opening (2) in a region that passes through projections (5, 6) on the respective front and rear walls.

7. Rear sight according to claim 6 characterized by the fact that on the front wall (9) of the sight as well as on the rear wall (10) thereof, projections (5, 6) are provided and that these project by about 0.2 mm over surrounding face areas of the walls.

8. The rear sight as in claim 1, wherein:

the guide part has side walls at respective ends of the lengthwise extent; and the horizontal opening (2) ends, in the lengthwise direction, at a distance from the side walls.

* * * * *